US008622146B2

(12) United States Patent
Klimek et al.

(10) Patent No.: US 8,622,146 B2
(45) Date of Patent: Jan. 7, 2014

(54) FIRE EXTINGUISHER AND METHOD

(76) Inventors: Christian Klimek, Straume (NO); Richard Tangen, Knarrevik (NO)

( * ) Notice: Subject to any disclaimer, the term of this patent is extended or adjusted under 35 U.S.C. 154(b) by 881 days.

(21) Appl. No.: 12/678,019

(22) PCT Filed: Sep. 12, 2008

(86) PCT No.: PCT/NO2008/000324
§ 371 (c)(1),
(2), (4) Date: Jun. 10, 2010

(87) PCT Pub. No.: WO2009/041822
PCT Pub. Date: Apr. 2, 2009

(65) Prior Publication Data

US 2010/0252283 A1 Oct. 7, 2010

(30) Foreign Application Priority Data

Sep. 14, 2007 (NO) ..... 20074711

(51) Int. Cl.
*A62C 2/00* (2006.01)

(52) U.S. Cl.
USPC ..... 169/46; 169/48; 169/49; 169/56; 169/65; 160/23.1; 126/25 C; 340/507; 340/577

(58) Field of Classification Search
USPC ..... 169/45, 46, 48–50, 54, 56, 65; 160/23.1; 428/920; 126/25 C, 221; 340/506, 507, 540, 577
See application file for complete search history.

(56) References Cited

U.S. PATENT DOCUMENTS

| | | | | |
|---|---|---|---|---|
| 3,209,837 | A | 10/1965 | Freedman | |
| 4,483,314 | A | 11/1984 | Parker, Jr. et al. | |
| 4,597,450 | A * | 7/1986 | Budmiger | 169/50 |
| 5,083,617 | A * | 1/1992 | Pierce, Jr. | 169/50 |
| 5,518,074 | A * | 5/1996 | Brotherson | 169/50 |
| 7,607,488 | B2 * | 10/2009 | Durham | 169/65 |

FOREIGN PATENT DOCUMENTS

| | | | |
|---|---|---|---|
| DE | 19538609 | A1 | 4/1996 |
| JP | 10155927 | A | 6/1998 |
| JP | 2005323811 | A | 11/2005 |
| JP | 2006122286 | A | 5/2006 |
| JP | 2006226611 | A | 8/2006 |

OTHER PUBLICATIONS

Patent Cooperation Treaty, International Preliminary Report on Patentability and Written Opinion, International Application No. PCT/US2008/00324, dated Mar. 16, 2010.
Patent Cooperation Treaty, International Search Report, Application No. PCT/US2008/000324, dated Dec. 22, 2008.

* cited by examiner

*Primary Examiner* — Steven J Ganey
(74) *Attorney, Agent, or Firm* — Kilpatrick Townsend & Stockton LLP

(57) ABSTRACT

A device for fire extinguishing is described, comprising a fire retardant cloth, which is arranged to cover objects upon a fire or the beginnings of a fire, to put out or prevent the fire from developing, wherein the fire retardant cloth is mounted in a release mechanism arranged to release the fire retardant cloth, in such a way that the cloth covers said objects, upon detection of the fire or development of the fire. A method for same is also disclosed.

28 Claims, 5 Drawing Sheets

FIRE EXTINGUISHER AND METHOD

This application is a national stage application that claims priority under 35 USC §§365 and 371 to PCT/NO2008/000324 filed Sep. 12, 2008, which claims priority to NO 20074711, filed Sep. 14, 2007.

The present invention relates to a device for fire extinguishing, comprising a fire retardant cloth, which is arranged to cover objects upon a fire or the beginnings of a fire, to put out or prevent the fire from developing. The invention also relates to a method for the same.

Fires that start at home are a great problem. In industrial kitchens and in business premises, there are defective, automatic fire extinguishing systems that are set off when the fire alarm goes off, with the possible overhead sprinkler system or the like being triggered. However, this is a problem in kitchens, as it is often cooking oil, fats or the like that is the cause of the fire and an overhead sprinkler system will make the situation worse. In most homes, automatic fire extinguishing systems are missing. Estimated numbers indicate that about 40% of all house fires start by dry out on a stove. In Norway alone, about 12% of all lethal house fires start by a dry out.

Therefore, there is a need for a fire extinguishing system for use in the home in particular, or also in industrial kitchens as an added safety and which can simply be fitted afterwards without changing the stove or other appliances and which can be placed, for example, immediately above the stove. The system can be automatic.

This is achieved by a device according to the present invention. The invention will be able to save lives in that a number of house fires can be considerably reduced. The invention will also save assets for the same reason. Insurance companies and the public authorities will thus be able to save items of value which in turn everybody will benefit from.

The device according to the invention shall be cheap to produce, simple to fit and thereby be very commercially saleable.

The above mentioned aims are achieved with a device as described herein in that the fire retardant cloth is mounted in a release mechanism arranged to release the fire retardant cloth, in such a way that the cloth covers said objects, upon detection of the fire or development of the fire.

The release mechanism can be connected to a control unit, said control unit being preferably coupled to sensors for detection of fire or heat, such as a flame sensor, a smoke sensor, a temperature sensor, etc.

The fire retardant cloth, in the main, is rolled up onto a roller in the release mechanism, and the release mechanism can further comprises at least one drive roller over which a free end of the fire retardant cloth lies in an inactive state, wherein said roller is arranged to roll out and/or throw out said cloth. Adjacent the drive roller, a second roller can be arranged, having an opposite direction of rotation, in where the free end of the fire retardant cloth is placed between said rollers.

Furthermore, the fire retardant cloth can comprise a weight element at said free end, when in inactivate state said free end extends out between the first and the second roller.

The release mechanism can comprise a spring and/or a rod arranged to force said rollers against each other and a lid can cover the release mechanism when this is inactive.

The release mechanism is preferably placed above a stove, or it can be integrated with equipment placed above a stove, such as a ventilation system and where a coupling box is connected between the stove and energy supply and which, on a signal from the control unit, is arranged to cut off the energy supply upon the detection of a fire or beginnings of a fire.

The invention also relates to a method to extinguish a fire or the beginnings of a fire on a stove, with a fire retardant cloth being placed over pans or the like on the stove, where there is a fire or the beginnings of a fire, to extinguish or prevent a fire developing, by placing a release mechanism having a rolled up fire retardant cloth over the stove, and upon detection of fire or the beginnings of fire, to roll out and/or throw out the fire retardant cloth, so that the cloth is placed over the stove.

An alternative embodiment, is described herein in that the fire retardant cloth is placed folded double over the stove, with the free end of the cloth comprising a weight element, so that said free end is rolled out and is placed at a rear area of the stove, and to roll/throw out the fire retardant cloth towards the forward area of the stove, and furthermore roll out the cloth so that the cloth lies down at the rear area again, with the help of the release mechanism.

The invention shall now be described in more detail with help of the enclosed figures, in which.

The present invention relates to a device for fire extinguishing, comprising a fire retardant cloth arranged to be placed over objects where there is a fire or the beginnings of a fire, such as pans or the like, on a stove. Such cloths are readily available and are characterised in that they are very resistant to high temperatures and direct flames. However, most of the fire retardant cloths are used in halls or tents, possibly as loose cloths that can be placed over a fireplace.

Figure 2:
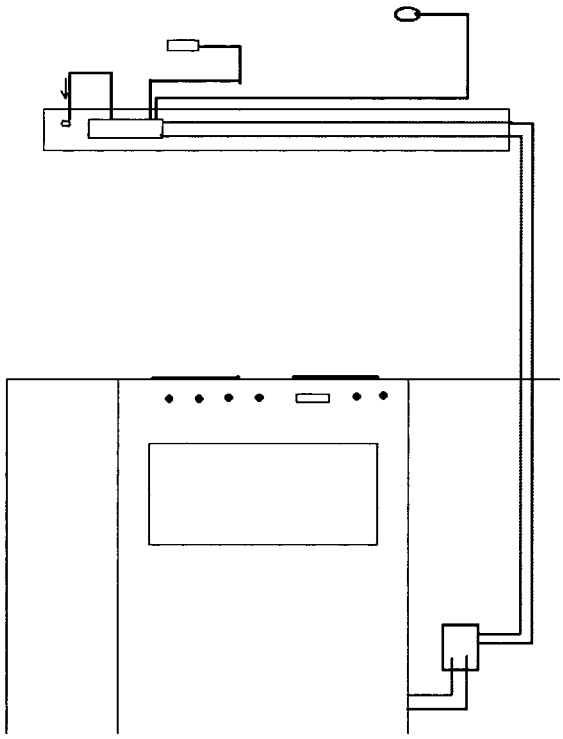
FIG. 2 shows a principle diagram for connecting up the present invention.

With the present invention, a self-releasing and automatic fire extinguishing system can be provided with the help of such a fire retardant cloth. However, the system also can be released by being activated by a user. The device can, as shown in FIG. 2, be arranged over a stove 40 and comprise a release mechanism 10 for a fire retardant cloth 12. The release mechanism 10 is, for example, connected to a control unit 50 which in turn is connected to a number of sensors, such as a temperature sensor 44, a smoke sensor 46, a flame sensor 48, etc, such that the control unit 50, after having analysed the signals from the sensors, is arranged to send a signal to the release mechanism 10 about releasing the fire retardant cloth 12.

Furthermore, the control unit 50 can be arranged to send a signal to a connecting box 42, coupled between the stove 40 and the electricity supply about cutting off the electricity supply upon detection of a fire or the beginnings of a fire. If the stove is a gas stove or the like, the connecting box can, in a corresponding way, be arranged to cut the energy supply to the stove.

Figure 1:
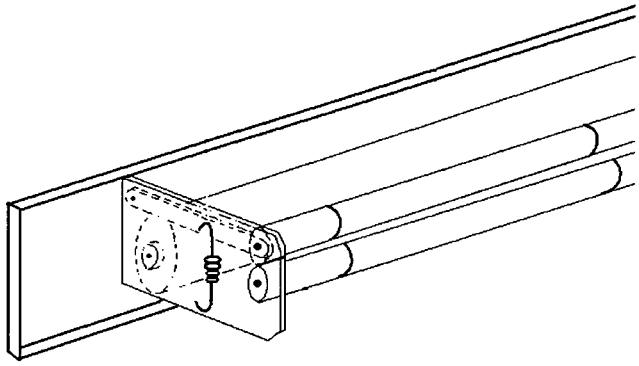
FIG. 1 shows parts of a device according to the invention.

FIG. 1 shows an example of a release mechanism 10 according to the invention, but other release mechanisms arranged to release, eject, roll out, etc, the fire retardant cloth are possible. The release mechanism 10 in the embodiment shown is placed above a stove, but the release mechanism can also be integrated with appliances placed over a stove such as a ventilation system.

As can be seen in FIG. 1, the release mechanism comprises a wall anchorage 16 to which two end plates 22 (only one being shown in the figure) are mounted approximately perpendicular to the wall anchorage 16, to support a roller 14 onto which the fire retardant cloth 12 is rolled up. At least one drive roller 18 is arranged in front of the roller 14 with the fire retardant cloth 16. A further drive roller 20 with a direction of rotation opposite to the drive roller 18 is preferably placed over the drive roller 18. The release mechanism 10 can further comprise a spring 24 and a rod 26 to pull said rollers 18,20 against each other. Furthermore, said rollers 18,20 can comprise a friction covering 28,30 arranged around at least parts of the rollers.

Figure 3:
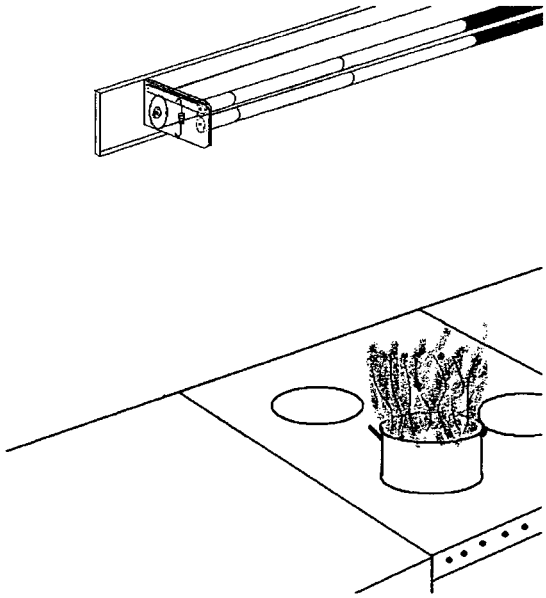
FIGS. 3-6 show the function of the present device upon detection of a fire or the beginnings of a fire on a stove.

The FIGS. 3 to 6 show release of the release mechanism 10 according to the invention. A stove 40 is shown in FIG. 3, on which a pan 41 is placed. The pan 41 has dried out and a fire has consequently started in the pan. One or more of the sensors in the control unit 50 register the beginnings of the fire and the control unit sends thereafter a signal to the release mechanism 10 to release the fire retardant cloth 12. The control unit 50 sends a corresponding signal to the connecting box 42 to cut the electricity supply or the energy source, such as gas, in the use of a gas stove. At the release of the fire retardant cloth 12, the drive roller 18 starts to roll out the cloth 12. The drive roller 18 is coupled to an associated drive unit (not shown). If an upper roller 20 is used, this also contributes to the rolling out of the cloth, in which the upper roller 20 can be pressed towards the lower drive roller 18 with the help of the spring 24 and the rod 26. The drive roller 18 can alternatively be mounted on top.

Figure 4:
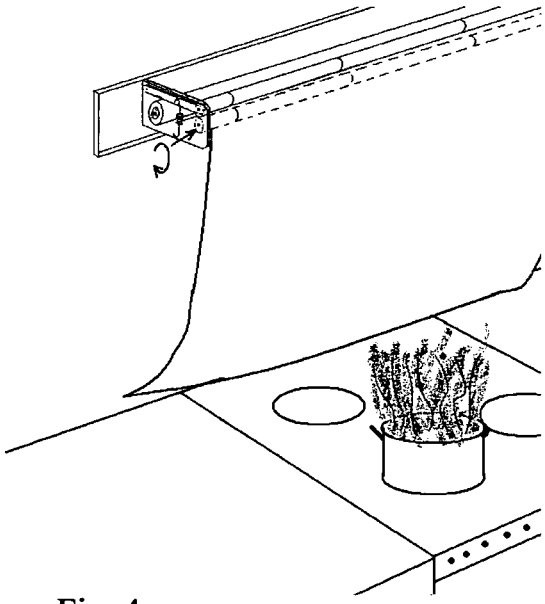
Figure 5:
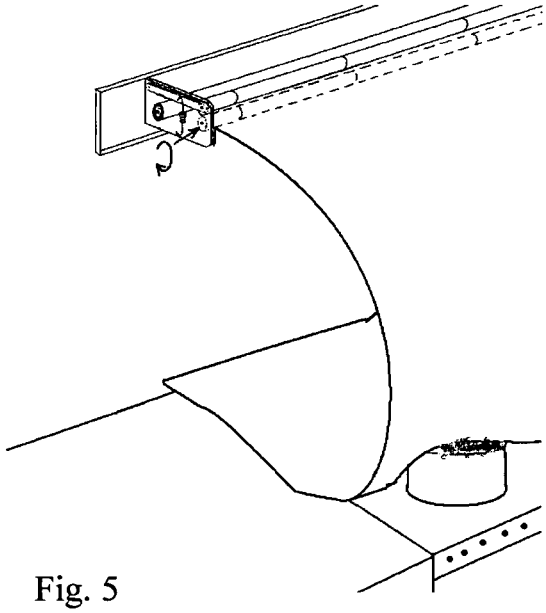
Figure 6:
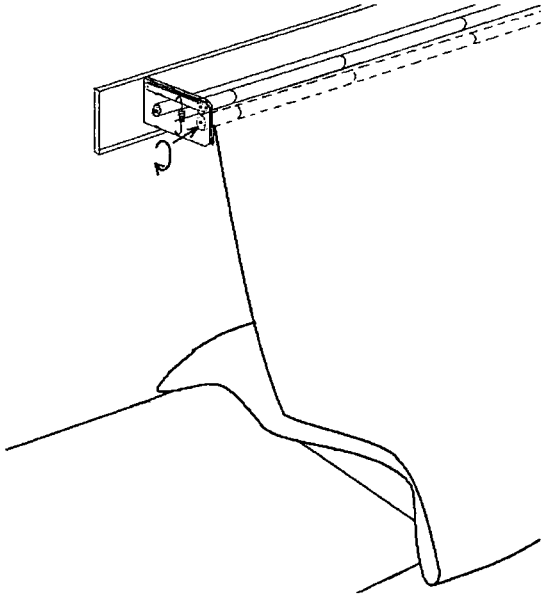

In the rolling out of the cloth 12, the free end of the cloth will first move towards the rear edge of the stove because of the weight element 12*a*, where the free end with the weight element settles, and the cloth is thereafter rolled/thrown out over the stove with the associated pan(s), as shown in FIGS. 4 and 5. By continued rolling out of the cloth, it will lie at the rear area of the stove again so that a double layer of fire retardant cloth 12 is placed over the stove 40.

Figure 7:
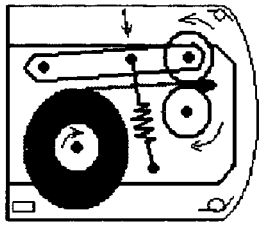
FIG. 7 shows an end section of a device according to the invention.
Figure 8:
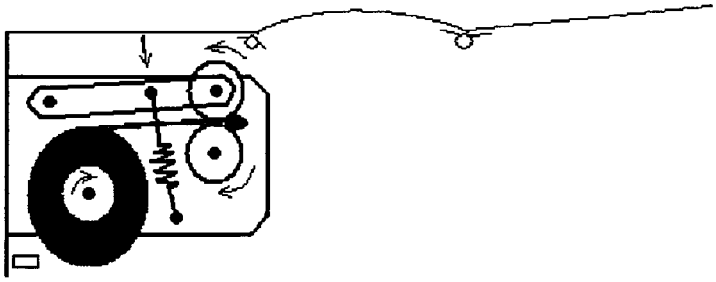
FIGS. 8-10 show the rolling out of a fire retardant cloth from the present device.
Figure 9:
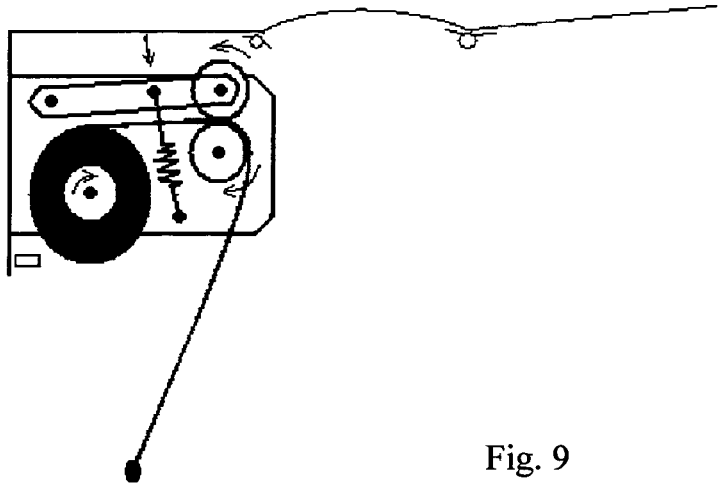
Figure 10:
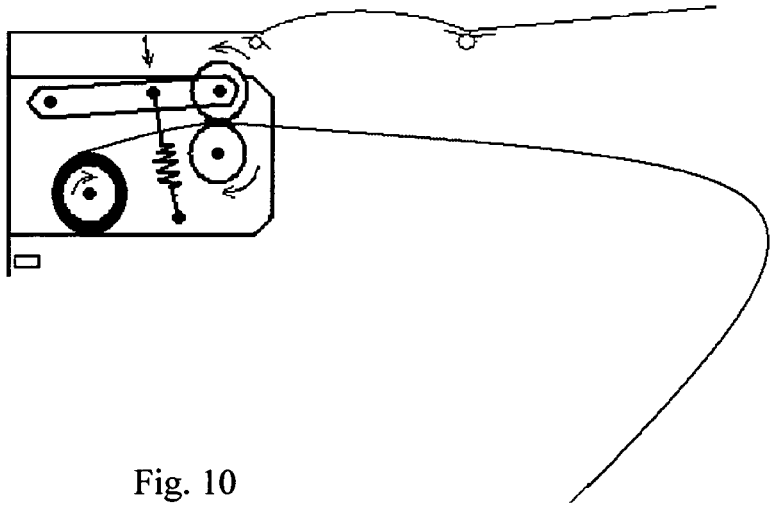

The FIGS. 7 to 10 show, corresponding to the above, the rolling out of the cloth 12 from the release mechanism 10. FIG. 7 shows the release mechanism 10 in an inactive state, where the free end 12*a* of the cloth, with the weight element, lies extending out between the rollers 18,20. As shown in the figure, the release mechanism 10 can be covered by a lid 32 which is opened when the release mechanism is triggered.

By varying the speed of the drive roller 18 of the release mechanism, the release of the cloth 12 can be regulated. At start up, the drive roller 18 can, for example, roll the cloth out relatively slowly so that the free end 12*a* of the cloth with the weight element lies down at the rear area of the stove as mentioned. Thereafter, the speed can be increased so that the cloth 12 is "thrown out" over the stove, whereupon the speed can be reduced to roll the cloth 12 back to the rear area of the stove. By regulating the speed, the release mechanisms can thus be adjusted to different application areas.

The fire retardant cloth 12 is shown in the figures rolled onto a roller 14. However, the cloth 12 can also be mounted in the release mechanism 10 in other ways, for example the cloth 12 can lie folded or pleated, or in another way.

The invention claimed is:

1. Device for fire extinguishing comprising a fire retardant cloth mounted in a release mechanism which is arranged to release the fire retardant cloth so that the cloth covers an object upon the detection of a fire or the beginnings of a fire, in that the fire retardant cloth is rolled up onto a roller in the release mechanism, wherein the release mechanism further comprises at least one drive roller over which a free end of the fire retardant cloth lies in an inactive state, and wherein a second roller, having an opposite direction of rotation, is arranged adjacent the drive roller, and that the free end of the fire retardant cloth is placed between said rollers, wherein said rollers are arranged to roll out and/or throw out said cloth to put out or prevent the fire from developing.

2. Device of claim 1, wherein the release mechanism is coupled to a control unit, said control unit being connected to a sensor for detection of fire or heat.

3. Device of claim 2, wherein the sensor comprises a flame sensor, a smoke sensor, or a temperature sensor.

4. Device of claim 2, wherein the release mechanism is placed above a stove.

5. Device of claim 4, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

6. Device of claim 2, wherein the release mechanism is integrated with equipment placed above a stove.

7. Device of claim 6, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

8. Device of claim 1, wherein the fire retardant cloth comprises a weight element in said free end, said free end extends in an inactive state out between the first and the second roller.

9. Device of claim 8, wherein the release mechanism is placed above a stove.

10. Device of claim 9, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

11. Device of claim 8, wherein the release mechanism is integrated with equipment placed above a stove.

12. Device of claim 11, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

13. Device of claim 1, wherein the release mechanism comprises a spring and/or a rod arranged to force said rollers against each other.

14. Device of claim 13, wherein the release mechanism is placed above a stove.

15. Device of claim 14, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

16. Device of claim 13, wherein the release mechanism is integrated with equipment placed above a stove.

17. Device of claim 16, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

18. Device of claim 1, wherein the release mechanism comprises a lid which is arranged to be released at the release of the release mechanism.

19. Device of claim 18, wherein the release mechanism is placed above a stove.

20. Device of claim 19, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

21. Device of claim 18, wherein the release mechanism is integrated with equipment placed above the stove.

22. Device of claim 21, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

23. Device of claim 1, wherein the release mechanism is placed above a stove.

24. Device of claim 23, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

25. Device of claim 1, wherein the release mechanism is integrated with equipment placed above a stove.

26. Device of claim 25, further comprising a connecting box, wherein the connecting box is coupled between the stove and an electricity supply or other energy source, and which upon a signal from a control unit, is arranged to cut off the energy supply to the stove upon the detection of fire or the beginnings of a fire.

27. Device of claim 25, wherein the equipment comprises a ventilation system.

28. Method to extinguish a fire or the beginnings of a fire on a stove, comprising:

placing a release mechanism having a rolled up fire retardant cloth over the stove, and, rolling out or throwing out the fire retardant cloth upon detection of a fire or the beginnings of a fire, by at least one drive roller, so that the cloth is placed over the stove, wherein the fire retardant cloth is placed folded double over the stove, with the free end of the cloth comprising a weight element, so that said free end is rolled out and is placed at a rear area of the stove, and to roll or throw out the fire retardant cloth towards the forward area of the stove, and furthermore roll out the cloth so that the cloth lies down at the rear area again, with the help of the release mechanism.

* * * * *